US006728499B2

(12) United States Patent
Ushio et al.

(10) Patent No.: US 6,728,499 B2
(45) Date of Patent: Apr. 27, 2004

(54) IMAGE FORMING APPARATUS WITH LEFT TIME INFORMING FUNCTION AND LEFT TIME CALCULATING METHOD

(75) Inventors: Masaru Ushio, Hachioji (JP); Masahiro Osawa, Hachioji (JP); Yoshihisa Kamata, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/243,466

(22) Filed: Sep. 12, 2002

(65) Prior Publication Data

US 2003/0059223 A1 Mar. 27, 2003

(30) Foreign Application Priority Data

Sep. 25, 2001 (JP) ..... 2001-290622

(51) Int. Cl.[7] ..... G03G 15/00
(52) U.S. Cl. ..... 399/75
(58) Field of Search ..... 399/42, 75, 76, 399/77, 79, 80, 81, 85; 395/114, 115, 116, 117, 561

(56) References Cited

U.S. PATENT DOCUMENTS 5,960,234 A * 9/1999 Shibaki et al. ..... 399/75
6,226,471 B1 * 5/2001 Tsuzuki ..... 399/75

OTHER PUBLICATIONS

English Statement of Japanese Patent Publication No. Tokukai–hei 3–27064.

English Statement of Japanese Patent Publication No. Tokukai–hei 4–67061.

* cited by examiner

*Primary Examiner*—Hoan Tran
(74) *Attorney, Agent, or Firm*—Squire, Sanders & Dempsey

(57) ABSTRACT

An image forming apparatus with a left time informing function, which can accurately predict time required for finishing forming an image. The image forming apparatus with a left time informing function, has: a storage for storing data of various types of basic operation time for forming an image, therein; and a status management section for calculating and informing left time required for completing forming the image on the basis of the data stored in the storage, when a condition of forming the image is determined; wherein the basic operation time include print time corresponding to a single-sided mode and a double-sided mode, respectively, for every size of a transfer sheet, and interprocessing time for every postprocessing.

7 Claims, 7 Drawing Sheets

FIG. 5A

| A2 | A3 | A4 | A5 | B3 | B4 | B5 | B6 |
|---|---|---|---|---|---|---|---|
| $\alpha_1$ SEC | $\alpha_2$ SEC | $\alpha_3$ SEC | $\alpha_4$ SEC | $\alpha_5$ SEC | $\alpha_6$ SEC | $\alpha_7$ SEC | $\alpha_8$ SEC |

FIG. 5B

| | | |
|---|---|---|
| STAPLING | ONE POSITION | $\beta_1$ SEC |
| | TWO POSITIONS | $\beta_2$ SEC |
| DUAL PAGE BINDING | STAPLING (ONE POSITION) | $\beta_3$ SEC |
| | STAPLING (TWO POSITIONS) | $\beta_4$ SEC |
| ONLY DUAL PAGE BINDING | | $\beta_5$ SEC |
| PUNCHING (TWO POSITIONS) | | $\beta_6$ SEC |

IMAGE FORMING APPARATUS WITH LEFT TIME INFORMING FUNCTION AND LEFT TIME CALCULATING METHOD

BACKGROUND OF THE INVENTION

1. Field of the Invention

The invention relates to an image forming apparatus with a left time informing function, that comprises a function for predicting time required for completing forming an image in case of copying a plurality of copies of a plurality of document sheets, or in case of copying a plurality of document sheets in double-sided sheets.

2. Description of Related Art

An image forming apparatus can combine functions automatically, according to the necessity, and copy to purpose, if an operator previously determines various types of conditions of forming the image by an operating panel.

However, in case there are a large number of copy sheets, or there are a large number of copies, it is difficult that the operator predicts how long the image forming apparatus takes to copy, and when the image forming apparatus finishes copying. As a result, the operator has to wait in front of the image forming apparatus only, until the image forming apparatus finishes copying. The reason is that the operator can not know when the copy is finished, and the delay of the operation is caused, if the operator leaves the front of the image forming apparatus.

Accordingly, the Japanese Patent Application Publication (Unexamined) No. Tokukai-hei 3-27064 proposes an image forming apparatus for calculating time required for copying on the basis of determined values, and displaying the time required for finishing copying, when an operator determines a copy mode such as a number of copy sheets, a single-sided copy or a double-sided copy, a reduced-size copy or an enlarged copy, or the like, before starting copying. Further, the Japanese Patent Application Publication (Unexamined) No. Tokukai-hei 4-67061 proposes an image forming apparatus for storing time required for completing copying for every copy condition in a memory, reading the time out of the memory when copying, and displaying the time required for finishing copying.

The image forming apparatus proposed in the former Japanese Patent Application Publication (Unexamined) No. Tokukai-hei 3-27064 comprises data concerning various types of basic operation time. The basic operations are various types of basic operations required by the image forming apparatus to predict the image forming operation time. For example, the basic operation time is print time for every size of a transfer sheet, print time in case of the double-sided mode, or the like.

However, according to the above-described techniques, although the finish time predicted by the image forming apparatus is displayed, there occurs the time difference between the predicted finish time and the time required for actually completing forming the image.

SUMMARY OF THE INVENTION

The present invention was developed in view of the above-described problems.

It is an object of the present invention to provide an image forming apparatus with a left time informing function and a left time calculating method, which can accurately predict time required for finishing forming an image.

In order to attain the above-described object, in accordance with a first aspect of the present invention, an image forming apparatus with a left time informing function, comprises: a storage for storing data of various types of basic operation time for forming an image, therein; and a status management section for calculating and informing left time required for completing forming the image on the basis of the data stored in the storage, when a condition of forming the image is determined; wherein the basic operation time include print time corresponding to a single-sided mode and a double-sided mode, respectively, for every size of a transfer sheet, and interprocessing time for every postprocessing.

Herein, the basic operation time mean time required for calculating the left time required for completing forming the image, and required by the image forming apparatus to perform basic operations. The postprocessing is a processing which the image forming apparatus performs to one copy of a plurality of document sheets, and includes, for example, a sorting, a stapling, a punching, a folding and so on.

In accordance with a second aspect of the present invention, an image forming apparatus with a left time informing function, comprises: a storage for storing data of various types of basic operation time for forming an image, therein; and a status management section for calculating and informing left time required for completing forming the image on the basis of the data stored in the storage, when a condition of forming the image is determined; wherein the basic operation time include print time which uses a transfer sheet feeding interval for every size of a transfer sheet, in case of a single-sided mode, and print time which is calculated based on a transfer sheet feeding interval for every size of the transfer sheet, circulation time the transfer sheet passes through an automatic duplex unit, and a number of circulation sheets capable of being contained in a course of the automatic duplex unit, in case of a double-sided mode.

Herein, the transfer sheet feeding interval is an interval of feeding the transfer sheet continuously. Usually, the interval in case of the single-sided mode and the interval in case of the double-sided mode are the same as each other. The circulation time is time the transfer sheet is reversed by the automatic duplex unit and goes round the automatic duplex unit, and time fixed according to the image forming apparatus. The number of circulation sheets is a number of transfer sheets which can be contained in the course of the automatic duplex unit, and a number determined based on the size of the transfer sheet, a feeding direction of the transfer sheet or the like, because the length of the course of the automatic duplex unit is constant.

Preferably, in the apparatus of the second aspect of the present invention, the print time A in case of the double-sided mode, is calculated according to the following equation:

$$A=\{(\text{the circulation time}/\text{the number of circulation sheets})+\text{the transfer sheet feeding interval}\}/2.$$

In accordance with a third aspect of the present invention, a left time calculating method, comprises: storing data of various types of basic operation time for forming an image; and calculating left time required for completing forming the image on the basis of the data stored, when a condition of forming the image is determined; wherein the basic operation time include print time corresponding to a single-sided mode and a double-sided mode, respectively, for every size of a transfer sheet, and interprocessing time for every postprocessing.

In accordance with a fourth aspect of the present invention, a left time calculating method, comprises: storing data of various types of basic operation time for forming an image; and calculating left time required for completing forming the image on the basis of the data stored, when a condition of forming the image is determined; wherein the basic operation time include print time which uses a transfer sheet feeding interval for every size of a transfer sheet, in case of a single-sided mode, and print time which is calculated based on a transfer sheet feeding interval for every size of the transfer sheet, circulation time the transfer sheet passes through an automatic duplex unit, and a number of circulation sheets capable of being contained in a course of the automatic duplex unit, in case of a double-sided mode.

Preferably, in the method of the third or fourth aspect of the present invention, the left time is calculated one by one and redisplayed, with a progress of forming the image.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein:

FIGS. 5A and 5B are tables showing exemplary data of basic operation time stored in a storage 111 of the status management device 110 shown in FIG. 3;

PREFERRED EMBODIMENTS OF THE INVENTION

Hereinafter, a preferred embodiment of the present invention will be explained with reference to figures, in detail.

Figure 1:
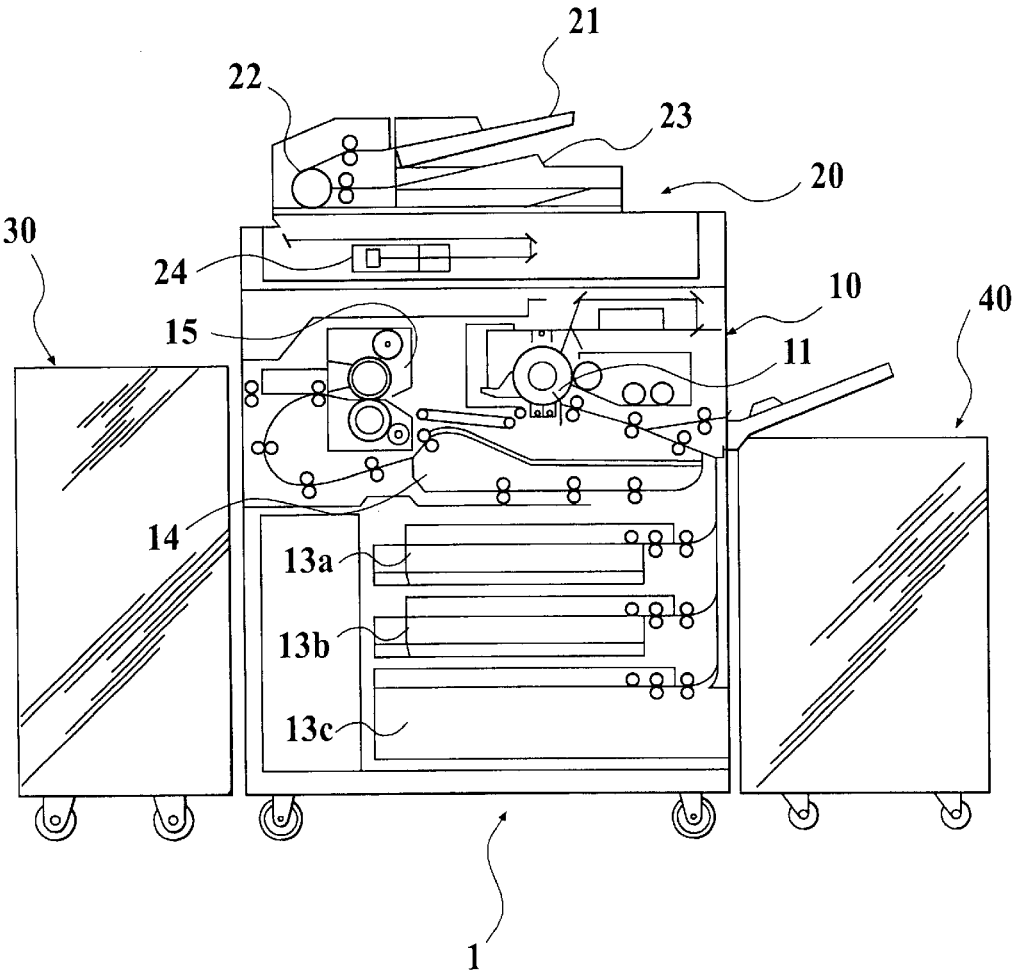
FIG. 1 is a view showing a structure of an image forming apparatus 1 of the present invention.

FIG. 1 is a view showing a structure of the image forming apparatus 1 of the present invention. In FIG. 1, the reference numeral 10 denotes an image former for forming an image on a transfer sheet according to an electrophotography system, the reference numeral 20 denotes an image reader for reading the image of the document, and outputting image data to the image former 10, the reference numeral 30 denotes a postprocessor for performing a postprocessing such as a sorting, a stapling, a punching, a folding or the like, to the transfer sheet output from the image former 10, and the reference numeral 40 denotes a large capacity tray of transfer sheet feeder which is provided at the image forming apparatus 1 as the occasion may demand, and which contains transfer sheets used for the image forming and fed to the image former 10.

The image former 10 electrifies, exposes and develops a light sensitive device 11, and forms a toner image on the light sensitive device 11. The toner image formed on the light sensitive device 11 is transferred on the transfer sheet, and fixed by a fixing device 15. The transfer sheet on which the toner image is fixed is output to the postprocessor 30. The image former 10 comprises transfer sheet feeders 13*a*, 13*b* and 13*c* for containing transfer sheets on which the image is formed, and an automatic duplex unit 14.

The large capacity tray of transfer sheet feeder 40 has a capacity capable of containing several times as many transfer sheets as the transfer sheet feeders 13*a*, 13*b* and 13*c* of the image former 10 contain.

The image reader 20 comprises a copy feeding tray 21 on which the document is put, a platen roller 22 for carrying the document and forming a reading position, a copy outputting tray 23 on which the document which has already read out, is put, and an image sensor 24 for receiving an image light and converting the image light to an image signal.

The operating panel is provided on an upper surface of the image forming apparatus 1. The operating panel consists of a LCD panel, a numeric keypad, a start key, or the like. On the operating panel, the operator inputs the condition of forming the image, that is the number of copy sheets, the copy mode such as the single-sided copy, the double-sided copy or the like, a magnification of the reduced-size copy or the enlarged copy, or the selection of the postprocessing such as the stapling, the position of the stapling or the like.

Figure 2:
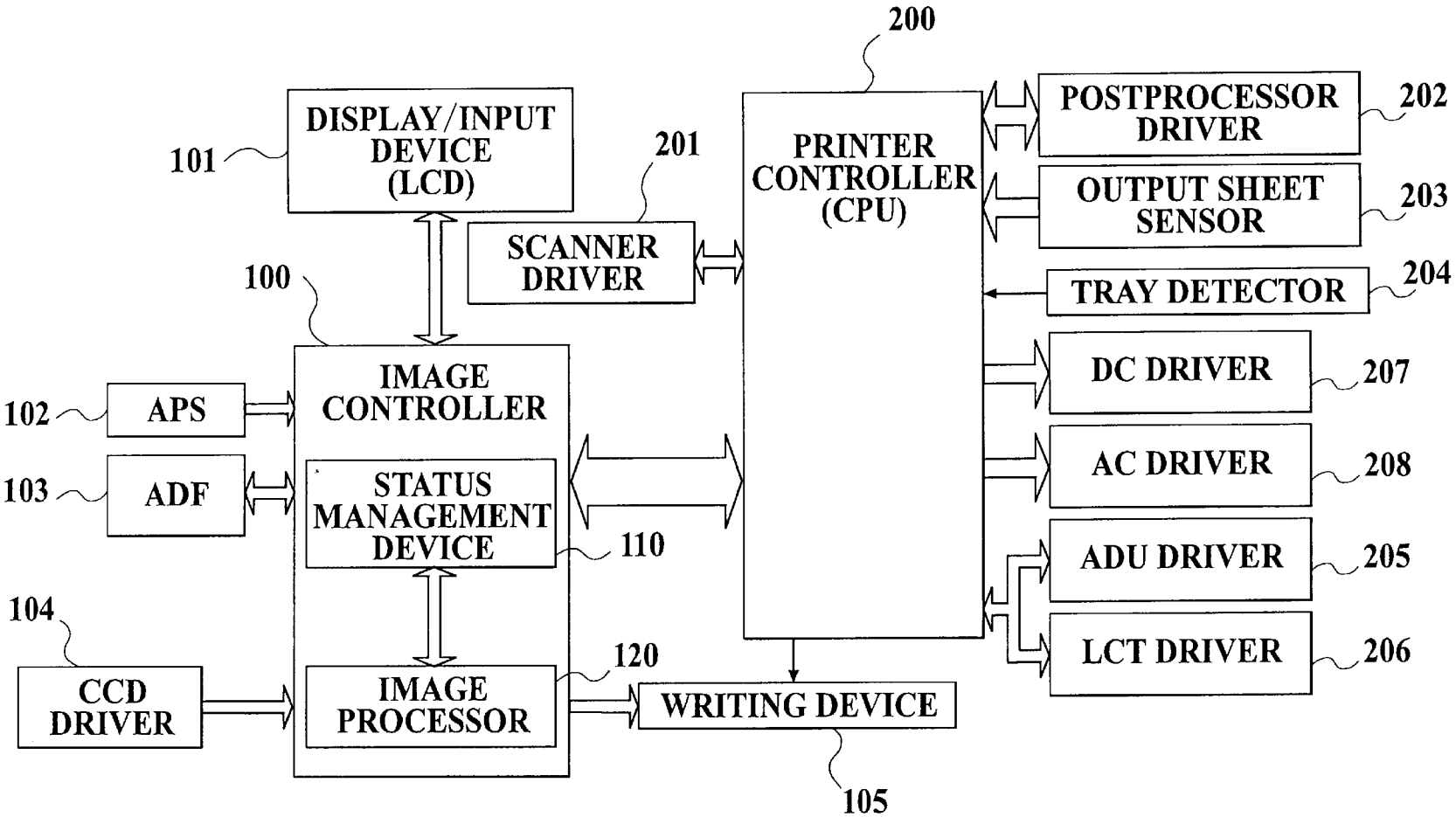
FIG. 2 is a block diagram showing a control device portion of the image forming apparatus 1 shown in FIG. 1.

FIG. 2 is a block diagram showing a control device portion of the image forming apparatus 1 shown in FIG. 1. As shown in FIG. 2, the control device consists of two control blocks of an image controller 100 and a printer controller 200. Each of the image controller 100 and the printer controller 200 comprises a CPU, a storage such as a flash memory, or the like, and controls the whole image forming apparatus 1 according to a program installed in the storage.

The image controller 100 is a device for reading the image of the document, selecting the transfer sheet, and selecting the number of copies, or the copy mode of the single-sided copy, the double-sided copy or the like. A display/input device 101, an automatic paper selector (APS) 102, an automatic document feeder (ADF) 103, a CCD driver 104 for controlling the image sensor 24, a writing device 105 or the like, is electrically connected to the image controller 100. Further, the image controller 100 comprises a status management device 110 and an image processor 120.

The display/input device 101 comprises the LCD display, the numeric keypad, the start key or the like, is used by the operator to input the condition of forming the image, or displays the present status. The automatic paper selector (APS) 102 is a sensor for supplying the document size data for making the image controller 100 automatically select the transfer sheet having the proper size, to the image controller 100, on the basis of the size of the document and the magnification of the reduced-size copy or the enlarged copy. The automatic document feeder (ADF) 103 is a device for sending a plurality of documents put on the document feeding tray 21 to the image reader 20, one by one. The CCD driver 104 reads out the document image formed on the image sensor 24. The image processor 120 compresses the document image data outputted from the CCD driver 104, and outputs the data to the writing device 105. The writing device 105 restores the document image data compressed by the image processor 120, and outputs the data to the printer controller 200. The printer controller 200 exposes the document image and forms the toner image on the light sensitive device, on the basis of the input data, and transfers the document image on the transfer sheet.

The printer controller 200 comprises a device for receiving the document image data outputted from the writing device 105, exposing the document image and forming the toner image on the light sensitive device, on the basis of the document image data, and transferring the document image on the transfer sheet. A scanner driver 201, a postprocessor driver 202, an output sheet sensor 203, a tray detector 204, an automatic duplex unit (ADU) driver 205, a large capacity tray transfer sheet feeder (LCT) driver 206, a DC driver 207, an AC driver 208 or the like is electrically connected to the printer controller 200.

The scanner driver 201 is a device for driving the scanner which reads out the document image. The postprocessor driver 202 is a device for driving the postprocessor 30 which performs the postprocessing such as a sorting, a stapling, a punching, a folding or the like to the transfer sheets output from the image former 10. The output sheet sensor 203 detects and counts the transfer sheets which are copied and output. The tray detector 204 detects the size of the transfer sheet contained in each tray.

Figure 3:
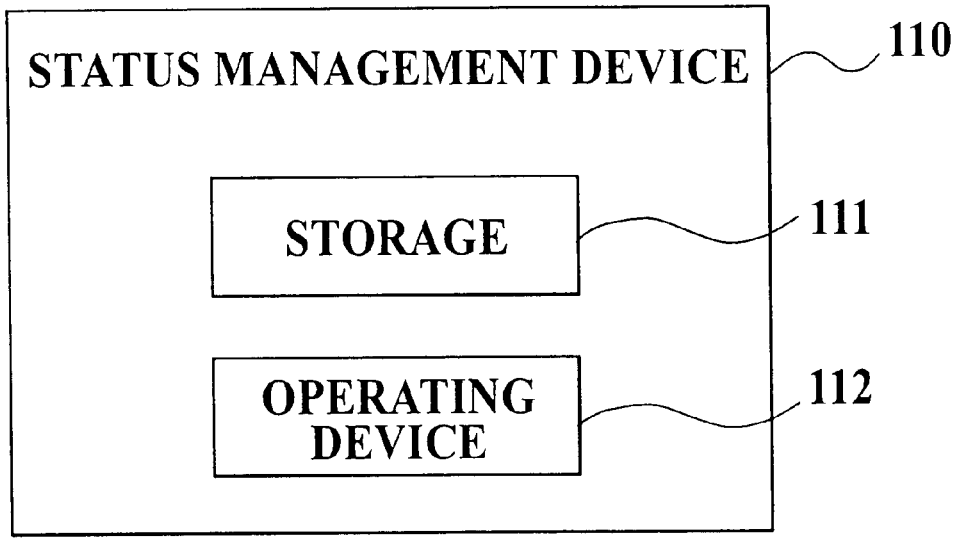
FIG. 3 is a block diagram showing a status management device 110 of the control device shown in FIG. 2.

FIG. 3 is a block diagram showing a structure of the status management device 110 of the image controller 100 shown in FIG. 2. As shown in FIG. 3, the status management device 110 comprises a storage 111 and an operating device 112. The storage 111 stores a data base storing time required by the image forming apparatus 1 to perform basic operations for forming the image, therein. The operating device 112 calculates the time required by the image forming apparatus 1 to complete forming the image, on the basis of the time required for performing basic operations of the data base stored in the storage 111.

Figure 4:
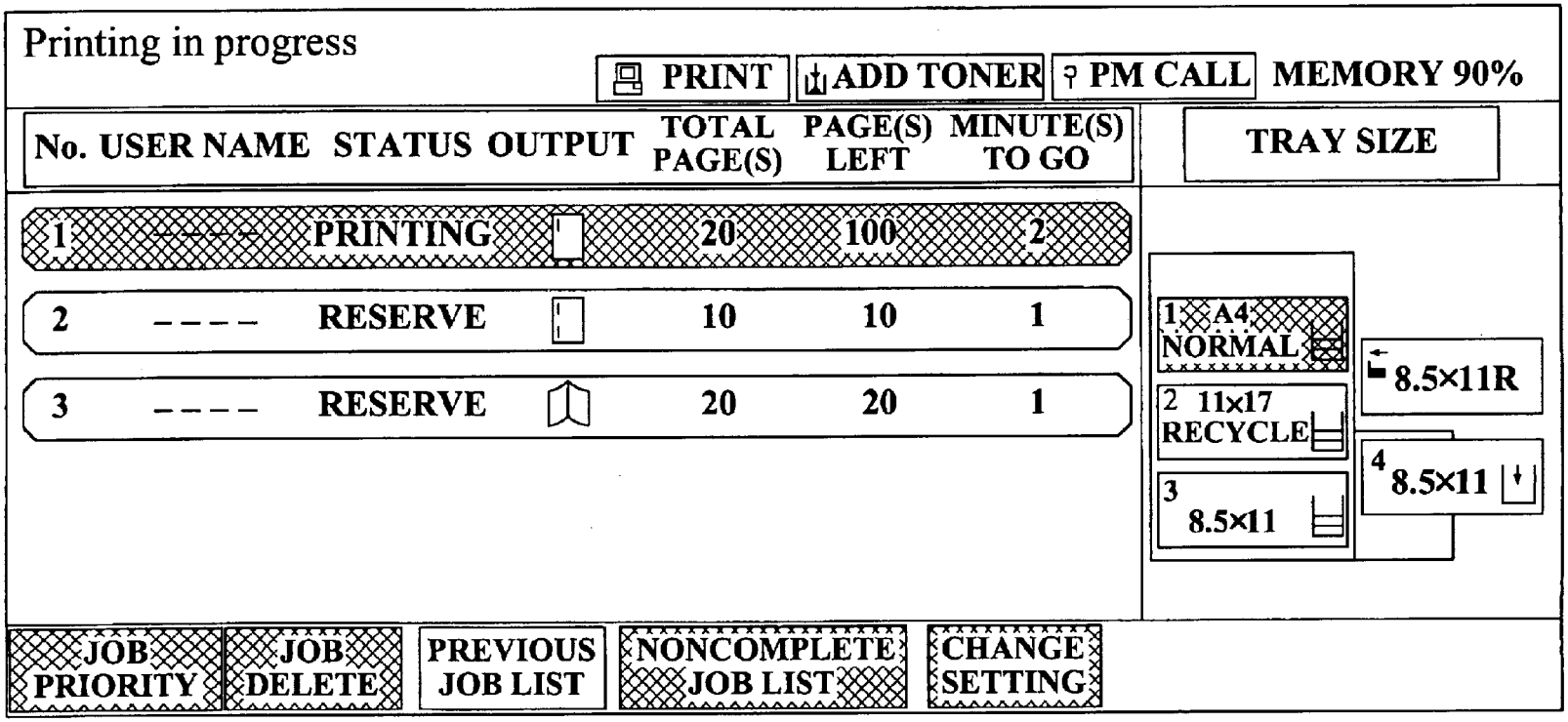
FIG. 4 is a view showing an exemplary display on a LCD screen of a display/input device 101 of the control device shown in FIG. 2.

FIG. 4 is a view showing an exemplary display on the LCD screen of the display/input device 101 connected to the image controller 100 shown in FIG. 2.

A selection screen of a "TRAY SIZE" is displayed on a right column on the LCD screen shown in FIG. 4. The selection screen of the "TRAY SIZE" shows that the A4 size of the transfer sheet is selected of various sizes of transfer sheets.

A recognition screen of the image forming status is displayed on a left column on the LCD screen. A "STATUS" column on the recognition screen of the image forming status shows the job's present status such as whether the job is progressing, waiting for being processed, or the like, at present. An "OUTPUT" column shows the postprocessing method input on another changed screen which is not shown in figures. A "TOTAL PAGE(S)" column shows the number of image sheets constructing one copy. A "PAGE(S) LEFT" column shows the number of left sheets. A "MINUTE(S) TO GO" column shows the left time.

Because the "STATUS" column of the job "No.1" displayed on a top on the recognition screen of the image forming status is "PRINTING", and the color thereof is changed, it is understood that the job "No.1" is the image forming operation which is progressing at present. The "OUTPUT" column of the job "No.1" shows that the postprocessing for stapling only one left upper position is selected. The "TOTAL PAGE(S)" column of the job "No.1" shows that the copy consists of twenty sheets. The "PAGE (S) LEFT" column of the job "No.1" shows that one hundred sheets are left to be copied. That is, because one copy consists of twenty sheets, and one hundred sheets are copied, it is understood that five copies are to be created. The final "MINUTE(S) TO GO" of column of the job "No.1" shows that the time required for finishing forming the image is two minutes.

The job "No.2" and the job "No.3" show that they are reserved jobs for forming the image, because the "STATUS" columns thereof are "RESERVE". When the job is reserved, and the document is put on the ADF 103, the document is read out at once. Then, "10" is shown on the "TOTAL PAGE(S)" column showing the number of document sheets of the job "No.2", and "20" is shown on the "TOTAL PAGE(S)" column of the job "No.3". Further, "10" is shown on the "PAGE(S) LEFT" column of the job "No.2", and "20" is shown on the "PAGE(S) LEFT" column of the job "No.3". Therefore, it is understood that one copy is to be generated, regarding each job.

In case of the job "No.1", because the number of document sheets is unknown until the documents put on the ADF 103 are read, it is impossible to calculate the left time accurately. However, in case of the reserved job such as the job "No.2" or the job "No.3", because the number of document sheets is known, it is possible to calculate the left time accurately.

According to the present invention, the operating device 112 calculates the left time T as follows. The operating device 112 can calculate the left time T in case of the single-sided copy, according to the following equation (1).

$$T=(BxC-D)xA+Ex(F-1) \quad (1)$$

On the other hand, the operating device 112 can calculate the left time T in case of the double-sided copy, according to the following equation (2).

$$T=\{((BxC)/2)-D\}xAx2+Ex(F-1) \quad (2)$$

Herein, parameters A to F of the equations (1) and (2) are determined, as follows.

A: a print time

B: a number of document sheets for every copy

C: a number of copies

D: a number of output sheets

E: an interprocessing time (a time required for performing the postprocessing shown in FIG. 5B)

F: a number of left copies (the single-sided copy)=the number of copies−a number of output copies=$C-(D/B)$ (3)

a number of left copies (the double-sided copy)=the number of copies−a number of output copies=$C-(2D/B)$ (4)

The print time A in case of the single-sided copy, is an interval of feeding the transfer sheet in case of the single-sided copy. The transfer sheet feeding interval is determined according to the size of the transfer sheet or the feeding direction.

The print time A in case of the double-sided copy, is calculated according to the following equation (5).

$$A=\{(\text{a circulation time/a number of circulation sheets})+\text{the transfer sheet feeding interval}\}/2 \quad (5)$$

In the equation (5), the "circulation time" is a time required that the transfer sheet goes round the automatic duplex unit 14, that is, the transfer sheet is reversed by the automatic duplex unit 14 and comes back to the transfer device. The circulation time is a characteristic time of the image forming apparatus 1. The "number of circulation sheets" is a number of transfer sheets which can be contained in the course of the automatic duplex unit 14, and changes according to the size of the transfer sheet, the feeding direction or the like, because the length of the course of the automatic duplex unit 14 is constant. The "transfer sheet feeding interval" is an interval in case of feeding the transfer sheets continuously, and the same as the conventional interval of the single-sided copy. As described above, it is possible to previously calculating the print time for every transfer sheet, and generate the database.

FIGS. 5A and 5B are tables showing exemplary data of basic operation time of the image forming apparatus 1, stored in the storage 111.

FIG. 5A is a table which stores the print time in case the image forming apparatus 1 performs the double-sided copy for every size of the transfer sheet, therein. The size of the transfer sheet is A2, A3, A4 . . . B6. The required time $\alpha_1$, $\alpha_2$, $\alpha_3$ . . . $\alpha_8$ (SEC) are corresponded to the sizes respectively, and stored as the basic operation time in the storage 111. The time are calculated according to the above-described equation (5).

FIG. 5B is a table which shows the type of the postprocessing performed by the image forming apparatus 1 and the time required for performing the postprocessing. The postprocessing is a processing the image forming apparatus 1 performs to one copy of a plurality of document sheets. There are various cases such as a case of stapling only one portion, a case of stapling two portions, a case of stapling one portion or two portions when both of binding dual pages and stapling, or the like, as the type of the postprocessing. The required time $\beta_1$, $\beta_2$, $\beta_3$, $\beta_4$ . . . $\beta_6$ (SEC) are corresponded to the cases respectively, and stored as the basic operation time in the storage 111. For example, the time can be calculated on the basis of a design value, an actual measurement value or the like.

FIGS. 5A and 5B show the exemplary basic operation time. Besides the data, the print time is determined according to the size of the transfer sheet or the feeding direction, in case the image forming apparatus 1 performs the single-sided copy. Further, preferably, the time required for copying or performing the postprocessing are corresponded to various types of basic operations such as the copy for every combination of the reduced-size or enlarged magnification and the size of the transfer sheet, and stored in the storage 111.

In the equations (1) and (2), the "print time A" can use one data selected from data stored in the storage 111 shown in FIG. 5A, if the size of the document and the reduced-size or enlarged magnification are determined in the condition of forming the image. The "number B of document sheets" can be known on the basis of the condition of forming the image or by reading the document sheets put on the ADF 103. The "number C of copies" can be obtained based on the condition of forming the image. The "number D of output sheets" can be known by counting with the tray detector 204. The "interprocessing time E" can use one data selected from the data stored in the storage 111 shown in FIG. 5B. The "number F of left copies" can be calculated by substituting the parameters B, C and D for the above-described equations (3) or (4).

As described above, when the operator puts the document sheets on the ADF 103 of the image forming apparatus 1, and inputs the number of copies, the magnification, the single/double-sided mode, and the postprocessing by the display/input device 101, before the image forming apparatus 1 starts the job, because the size of the document sheet is detected automatically, in a state the document sheets are put on the ADF 103, the size of the transfer sheet is determined on the basis of the magnification. Accordingly, in case the image forming apparatus 1 knows the number of document sheets, the image forming apparatus 1 can calculate the time required for completing forming the image.

The number B of document sheets is determined at the time the ADF 103 reads all the document sheets which are put thereon. Therefore, while the number B of document sheets is not determined, the time calculated by the image forming apparatus 1 is uncertain. However, because the uncertain time becomes shorten relatively as the number C of copies becomes large, it is possible to reduce the influence on the time required for completing copying. Accordingly, because when the operator leaves the image forming apparatus 1 after the image forming apparatus 1 completes reading the document sheets, to output a large number of copies, the time required for completing copying becomes certain, it is understood the calculation of the time is effective. Further, in case the operator reserves the job, because the ADF 103 reads the document sheets in advance, the number B of document sheets is a known number from the start. Therefore, the image forming apparatus 1 can calculate the accurate time required for completing copying. Accordingly, when the operator reserves the job to copy necessarily, it is possible that the image forming apparatus 1 calculates the left time accurately.

Figure 6:
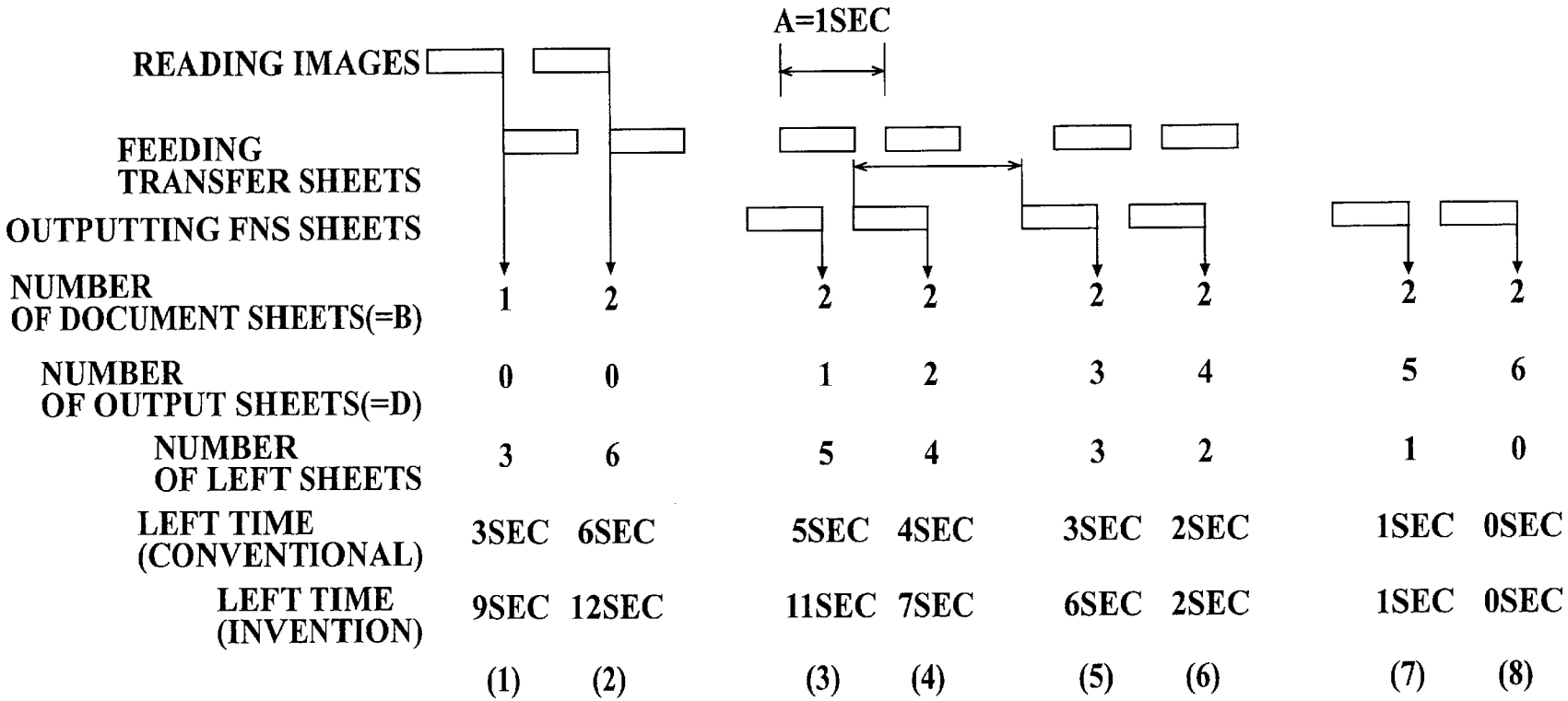
FIG. 6 is a view showing an example of calculating left time in case the image forming apparatus 1 performs a postprocessing.

FIG. 6 is a view showing an example wherein the image forming apparatus 1 calculates the left time in case the number B of document sheets is two (B=2), the number C of copies is three (C=3), and the interprocessing is to sort and staple one portion. Hereinafter, the method for calculating the left time at each of time (1) to (8) in FIG. 6 will be explained, as follows.

Time (1) in FIG. 6:

First, the operator puts two document sheets on the ADF 103, selects three as the number C of copies and to staple one portion as the postprocessing, and pushes the start button. Then, the ADF 103 detects the size of the put document sheets. The image controller 100 selects the same size of transfer sheet as the size of the document sheet when the magnification is not specified. When the ADF 103 sends the first document sheet, the image reader 20 reads the image of the first document sheet. At the same time the image reader 20 finishes reading the first document sheet, the image former 10 feeds the transfer sheet. At the time, because the number B of document sheets (the number of document sheets which are read completely) is one (B=1), and the number C of copies is three (C=3), the image forming apparatus 1 calculates the number of left sheets and obtains three. According to the conventional left time calculating method, because the interprocessing time required for performing the postprocessing is not considered, the left time T is determined to be 3 seconds (T=3) by multiplying 3 which is the number of left sheets by 1 (second) which is the print time A (A=1).

On the other hand, according to the present invention, the image forming apparatus 1 considers the time required for performing the postprocessing (the sorting and the stapling one portion in the case) besides the print time A. Therefore, the operating deice 112 obtains one second as the print time A (A=1), and three seconds as the interprocessing time E (E=3) from the data stored in the storage 111, calculates the left time T (=3(the number of left sheets)×1(second)(the print time A)+3(seconds)(the interprocessing time E)×(3(the number of left copies F)−1)), and obtains 9 seconds (T=9).

Time (2) in FIG. 6:

When the ADF 103 sends the second document sheet, the image reader 20 reads the image of the second document sheet, and the image former 10 feeds the transfer sheet. At the time, because any document sheet is not put on the ADF 103, the number B of document sheets is determined to be two (B=2). Because the transfer sheet is kept on the post-processor 30 and is not output yet, the number D of output sheets is zero (D=0), and the number of left sheets is six (=2×3). According to the conventional left time calculating method, the left time T is 6 seconds (=6×1) by multiplying 6 which is the number of left sheets by 1 (second) which is the print time A. On the other hand, according to the calculating method of the present invention, the operating device 112 calculates the left time T (=6(the number of left sheets)×1(second)(the print time A)+3(seconds)(the interprocessing time E)×(3 (the number of left copies F)−1)), and obtains 12 seconds (T=12).

Time (3) in FIG. 6:

In order to copy the second copy of document sheets, the image former 10 feeds the first transfer sheet, and the postprocessor 30 sorts and outputs the last first transfer sheet which is copied completely. At the time, the number B of document sheets is not changed, the number D of output sheets is one (D=1), and the number of left sheets is five. According to the conventional left time calculating method, the left time T is 5 seconds. On the other hand, according to the calculating method of the present invention, the left T is 11 seconds (=5(the number of left sheets)×1(second)+3 (seconds)(the interprocessing time E)×(3(the number of left copies F)−1)).

Time (4) in FIG. 6:

The image former 10 feeds the second copy of the second transfer sheet, and the first copy of the second sheet is output. At the time, the number B of document sheets is two (B=2), the number D of output sheets is two (D=2), and the number of left sheets is four. Because the first of copy is output completely, the number of left copies is two. According to the conventional left time calculating method, the left time T is 4 seconds. On the other hand, according to the calculating method of the present invention, the left time T is 7 seconds (=4(the number of left sheets)×1(second)+3 (seconds)(the interprocessing time E)×(2(the number of left copies F)−1)).

Time (5) in FIG. 6:

The image former 10 feeds the third copy of the first transfer sheet, the second copy of the first sheet is output. At the time, the number of left sheets is three. According to the conventional left time calculating method, the left time T is 3 seconds. On the other hand, according to the calculating method of the present invention, the left time T is 6 seconds (=3(the number of left sheets)×1(second)+3(seconds)(the interprocessing time E)×(2(the number of left copies F)−1)).

Time (6) in FIG. 6:

The image former 10 feeds the third copy of the second transfer sheet, the second copy of the second sheet is output. At the time, the number of output sheets is four, the number of left sheets is two, and the number of left copies is one. Therefore, because the interprocessing time is unnecessary, according to both of the conventional left time calculating method and the calculating method of the present invention, the left time T is 2 seconds.

Time (7) in FIG. 6:

The image former 10 outputs the third copy of the first sheet. At the time, the number of output sheets is five, and the number of left sheets is one. Therefore, According to both of the conventional left time calculating method and the calculating method of the present invention, the left time T is 1 second.

Time (8) in FIG. 6:

When the image former 10 outputs a last transfer sheet which is the third copy of the second sheet, the present image forming processing finishes.

As clearly understood in the exemplary embodiment shown in FIG. 6, the larger the number of left sheets is, or the larger the number of copies is, the larger the difference between the left time calculated according to the conventional calculating method and the actual left time is. On the other hand, according to the present invention, because the interprocessing time is considered, it is possible to display the approximate accurate left time one by one. For example, in case of copying one thousand copies of sheets, according to the conventional left time calculating method, the left time is 50 minutes. However, according to the calculating method of the present invention, the left time is 150 minutes, and it is possible that the left time coincides with the actual left time approximately.

Figure 7:
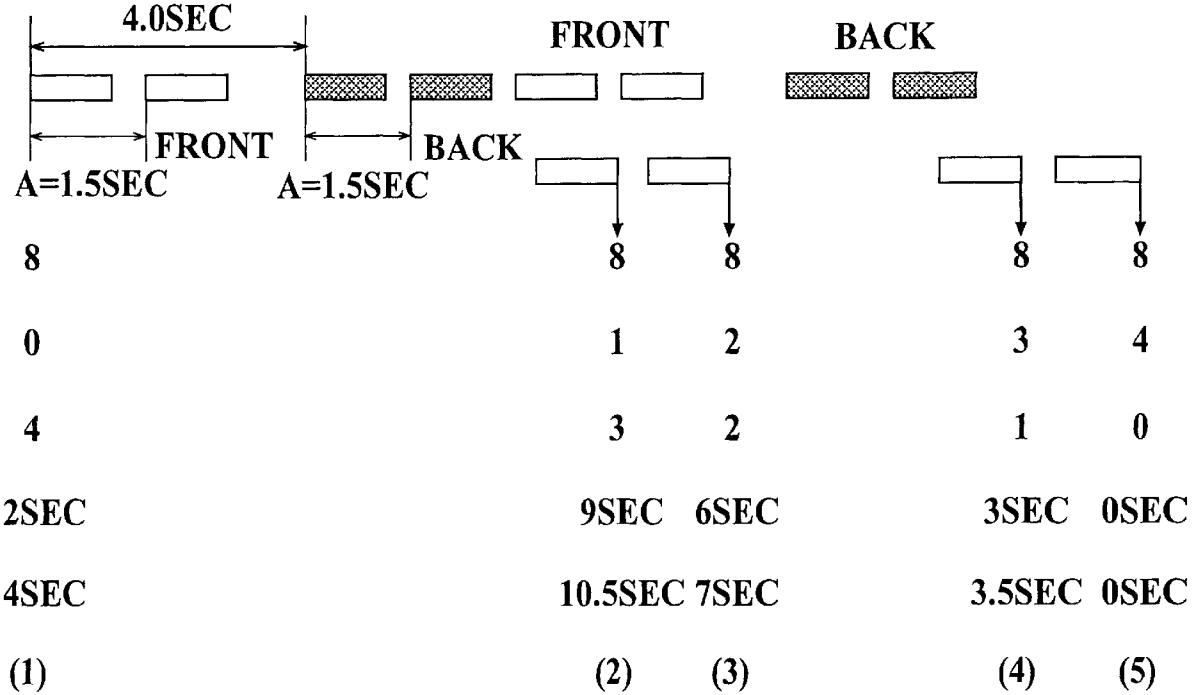
FIG. 7 is a view showing an example of calculating left time in case the image forming apparatus 1 copies in double-sided sheets.

FIG. 7 is a view showing an example wherein the image forming apparatus 1 calculates the left time when performing the double-sided copy, in case the number B of document sheets is eight (B=8) and the number C of copies is one (C=1). For some reasons of explanation, it will be explained from the time the ADF 103 finishes sending and reading eight document sheets.

Time (1) in FIG. 7:

When the image reader 20 completes reading the document sheets, because the number B of document sheets is eight (B=8), and any sheet is not output, the number D of output sheets is zero (D=0). Therefore, the number of left sheets is four obtained by dividing B by 2 (B/2).

In case the circulation time of the automatic duplex unit (ADU) 14 is 4.0 seconds, and the feeding interval of the transfer sheet is 1.5 seconds, the number of transfer sheets (the number of circulation sheets) contained in the automatic duplex unit 14 is two. Therefore, the print time A in case of the double-sided copy, is 1.75 seconds (={(4/2)+1.5}/2) according to the equation (5).

Conventionally, 1.5 seconds which are the print time A in case of the single-sided copy of the transfer sheet as described above, is used as the value of the print time A in case of the double-sided copy, and the left time T is calculated. However, it is characteristic of the present invention to consider "the circulation time" and "the number of circulation sheets" concerning the print time A in case of the double-sided copy.

The length and the circulation time of the automatic duplex unit 14 are fixed and constant values to the image forming apparatus 1. On the other hand, the number of circulation sheets changes according as the size of the transfer sheet or the feeding direction changes. Therefore, the print time of the double-sided mode changes necessarily, according as the number of circulation sheets changes. However, the quantity of the change of the print time A of the double-sided mode almost has no connection with the print time A of the single-sided mode. Regardless of it, conventionally, when the size of the transfer sheet or the feeding direction does not change, the print time of the double-sided mode and the print time of the single-sided mode have been considered to be the same. As a result, there has occurred the large difference between the calculated left time and the actual left time.

When the time (1) in FIG. 7 will be explained again, according to the conventional left time calculating method which regards the print time A as 1.5 seconds, the left time T is 12 seconds (=8×1.5(seconds)). On the other hand, according to the calculating method of the present invention which regards the print time A as 1.75 seconds, the left time T is 14 seconds (=8×1.75(seconds)) and can approximate the actual left time.

At the time (1) in FIG. 7, next, the image former 10 feeds the first transfer sheet, and prints in the front of the first transfer sheet. Then, when the feeding interval of 1.5 seconds passes, the image former 10 feeds the second transfer sheet, and prints in the front of the second transfer sheet. When the first transfer sheet enters the automatic duplex unit (ADU) 14 as it is, and goes round it (after four seconds), the first transfer sheet is reversed. When the first transfer sheet comes back, next, the image former 10 prints in the back of the first transfer sheet. Then, when the feeding interval of 1.5 seconds passes, the image former 10 prints in the back of the second transfer sheet. Thereafter, when the same feeding interval of 1.5 seconds passes, the image former 10 feeds the third transfer sheet, and prints in the front of the third transfer sheet. While printing in the front of the third transfer sheet, the image former 10 outputs the first transfer sheet in the double sides of which the documents are copied.

Time (2) in FIG. 7:

At the time the image former 10 outputs the first transfer sheet, the number D of output sheets is one (D=1), and the number of left sheets is three. When the left time T is calculated according to the conventional left time calculating method, the left time T is 9 seconds (=1.5(seconds)(the print time A)×3×2). On the other hand, when the left time T is calculated according to the calculating method of the present invention, the left time T is 10.5 seconds (=1.75 (seconds)(the print time A)×3×2).

Time (3) in FIG. 7:

While feeding the fourth transfer sheet, and printing in the front of the fourth transfer sheet, the image former 10 outputs the second transfer sheet in the back of which the document image is printed. Therefore, the number D of output sheets is two (D=2), and the number of left sheets is two. When the left time T is calculated according to the conventional left time calculating method, the left time T is 6 seconds (=1.5(seconds)(the print time A)×2×2). On the other hand, when the left time T is calculated according to the calculating method of the present invention, the left time T is 7 seconds (=1.75(seconds)(the print time A)×2×2).

Thereafter, when the circulation time of 4.0 seconds passes from the third transfer sheet is fed, the third transfer sheet is reversed, and fed again. Then, when the feeding interval of 1.5 seconds passes, the fourth transfer sheet is reversed, and fed again. While printing in the back of the fourth transfer sheet, the image former 10 outputs the third transfer sheet.

Time (4) in FIG. 7:

At the time the image former 10 outputs the third transfer sheet, the number D of output sheets is three (D=3), and the number of left sheets is one. When the left time T is calculated according to the conventional left time calculating method, the left time T is 3 seconds (=1.5(seconds)(the print time A)×1×2). On the other hand, when the left time T is calculated according to the calculating method of the present invention, the left time T is 3.5 seconds (=1.75 (seconds)(the print time A)×1×2).

Time (5) in FIG. 7:

When 1.5 seconds pass from the third transfer sheet is output, the image former 10 outputs the fourth transfer sheet. As a result, the present image forming processing finishes, and the left time T is 0 second (T=0).

According to the exemplary embodiment shown in FIG. 7, because "the circulation time" and "the number of circulation sheets" are considered when the print time A of the double-sided copy is determined, the accuracy of calculating the left time T is improved as the number of document sheets becomes large. In case of forming images of one thousand sheets, the left time is 25 minutes according to the conventional calculating method, and the left time is 29 minutes according to the calculating method of the present invention and coincides with the actual left time approximately.

According to the present invention, the following effects will be indicated.

As described above, the image forming apparatus of the present invention, comprises: the storage for storing data of various types of basic operation time for forming the image, therein; and the status management section for calculating and informing left time required for completing forming the image on the basis of the data stored in the storage, when the condition of forming the image is determined; wherein the basic operation time include print time corresponding to the single-sided mode and the double-sided mode, respectively, for every size of the transfer sheet, and interprocessing time for every postprocessing, or the basic operation time include print time which uses a transfer sheet feeding interval for every size of a transfer sheet, in case of a single-sided mode, and print time which is calculated based on a transfer sheet feeding interval for every size of the transfer sheet, circulation time the transfer sheet passes through an automatic duplex unit, and a number of circulation sheets capable of being contained in a course of the automatic duplex unit, in case of a double-sided mode. Consequently, it is possible to calculate the left time more accurately.

Further, the image forming apparatus comprises the structure wherein the print time A in case of the double-sided mode, is calculated according to the following equation: A={(the circulation time/the number of circulation sheets)+ the transfer sheet feeding interval}/2. Consequently, it is possible to calculate the left time of the double-sided mode more accurately.

The entire disclosure of Japanese Patent Application No. Tokugan 2001-290622 filed on Sep. 25, 2001 including specification, claims, drawings and summary are incorporated herein by reference in its entirety.

What is claimed is:

1. An image forming apparatus with a left time informing function, comprising:

a storage for storing data of various types of basic operation time for forming an image, therein; and a status management section for calculating and informing left time required for completing forming the image on the basis of the data stored in the storage, when a condition of forming the image is determined;

wherein the basic operation time include print time corresponding to a single-sided mode and a double-sided mode, respectively, for every size of a transfer sheet, and interprocessing time for every postprocessing.

2. An image forming apparatus with a left time informing function, comprising:

a storage for storing data of various types of basic operation time for forming an image, therein; and a status management section for calculating and informing left time required for completing forming the image on the basis of the data stored in the storage, when a condition of forming the image is determined;

wherein the basic operation time include print time which uses a transfer sheet feeding interval for every size of a transfer sheet, in case of a single-sided mode, and print time which is calculated based on a transfer sheet feeding interval for every size of the transfer sheet, circulation time the transfer sheet passes through an automatic duplex unit, and a number of circulation sheets capable of being contained in a course of the automatic duplex unit, in case of a double-sided mode.

3. The apparatus of claim 2, wherein the print time A in case of the double-sided mode, is calculated according to the following equation:

$$A=\{(\text{the circulation time}/\text{the number of circulation sheets})+\text{the transfer sheet feeding interval}\}/2.$$

4. A left time calculating method, comprising:

storing data of various types of basic operation time for forming an image; and calculating left time required for completing forming the image on the basis of the data stored, when a condition of forming the image is determined;

wherein the basic operation time include print time corresponding to a single-sided mode and a double-sided mode, respectively, for every size of a transfer sheet, and interprocessing time for every postprocessing.

5. The method of claim 4, wherein the left time is calculated one by one and redisplayed, with a progress of forming the image.

6. A left time calculating method, comprising:

storing data of various types of basic operation time for forming an image; and calculating left time required for completing forming the image on the basis of the data stored, when a condition of forming the image is determined;

wherein the basic operation time include print time which uses a transfer sheet feeding interval for every size of a transfer sheet, in case of a single-sided mode, and print time which is calculated based on a transfer sheet feeding interval for every size of the transfer sheet, circulation time the transfer sheet passes through an automatic duplex unit, and a number of circulation sheets capable of being contained in a course of the automatic duplex unit, in case of a double-sided mode.

7. The method of claim 6, wherein the left time is calculated one by one and redisplayed, with a progress of forming the image.

* * * * *